United States Patent [19]

Murata

[11] Patent Number: 5,008,138

[45] Date of Patent: Apr. 16, 1991

[54] PLATEN ROLLER

[75] Inventor: Jun Murata, Kawagoe, Japan

[73] Assignee: Canon Kabushiki Kaisha, Tokyo, Japan

[21] Appl. No.: 368,936

[22] Filed: Jun. 19, 1989

Related U.S. Application Data

[63] Continuation of Ser. No. 55,058, May 28, 1987, abandoned.

[30] Foreign Application Priority Data

Jun. 5, 1986 [JP] Japan ..... 61-129291

[51] Int. Cl.[5] ..... B41J 11/057

[52] U.S. Cl. ..... 428/36.4; 428/36.8; 29/132; 400/648; 400/659

[58] Field of Search ..... 400/648, 659; 428/36, 428/36.4, 36.8; 29/132

[56] References Cited

U.S. PATENT DOCUMENTS

| | | | |
|---|---|---|---|
| 4,028,786 | 6/1977 | Dempster | 29/132 |
| 4,317,265 | 3/1982 | Chase et al. | 29/132 |
| 4,449,278 | 5/1984 | Geyken et al. | 29/132 |
| 4,551,894 | 11/1985 | Beucker | 29/130 |
| 4,662,045 | 5/1987 | Grödum | 29/447 |

FOREIGN PATENT DOCUMENTS

| | | |
|---|---|---|
| 0062140 | 10/1982 | European Pat. Off. . |
| 63385 | 8/1968 | Fed. Rep. of Germany . |
| 3406836 | 10/1982 | Fed. Rep. of Germany . |
| 58-25979 | 2/1983 | Japan . |
| 60-151077 | 8/1985 | Japan . |
| 60-162672 | 8/1985 | Japan . |

*Primary Examiner*—James Seidleck

*Attorney, Agent, or Firm*—Fitzpatrick, Cella, Harper, & Scinto

[57] ABSTRACT

A platen roller comprises a rubber material having a glass transition temperature within the range of from −10° C. to 40° C. mounted around a core metal material.

5 Claims, 2 Drawing Sheets

PLATEN ROLLER

This application is a continuation of application Ser. No. 055,058 filed May 28, 1987, now abandoned.

BACKGROUND OF THE INVENTION

1. Field of the Invention

This invention relates to a platen roller, more particularly to a platen roller to be used in a printing device such as a typewriter, etc.

2. Related Background Art

Printing device such as a typewriter, etc., conventionally has a platen roller which acts as the base plate during printing. The platen roller is ordinarily columnar with a rubber material or resin material 2 wound around a core metal portion 1 as shown in FIG. 1, and characters of the daisy wheel 5 are printed on the paper for printing 3, by pressing of the daisy wheel 5 struck by the printing hammer 6 at the portion where the ink ribbon 4 is contacted on the paper for printing 3 around the platen roller as shown in FIG. 2.

The present inventors have confirmed by experiments that the performance of printing on the paper for printing as obtained above is influenced by the shock load when the daisy wheel 5 is pressed against the paper. The shock load is determined by the hardness of the rubber material, and the strength of the force, speed, etc., of the hammer which strikes the daisy wheel. If the shock load is deficient, inferior printing such as lacking of a part of letter, indistinct outline of letter, etc., will be generated.

Generation of such inferior printing is a serious problem in typewriter of the prior art, and is frequently generated generally when the environment temperature is higher. This inferior printing occurs not only in typewriters of the manual type wherein the shock load becomes irregular, but also in electronic typewriters in which a machine applies constant shock force on a daisy wheel, and particularly the phenomenon of further frequent occurrence is observed when the temperature of the platen roller is elevated by continuous printing for a long time.

Whereas, the present inventor has found that the printing performance is influenced not only by shock load, but also by shock attenuating ability. Printing performance can be improved by improving the shock attenuating ability as represented by resilient elasticity (making smaller resilient elasticity). Also in the case of a rubber material, the shock attenuating ability was found to become greater at a temperature around the glass transition point.

SUMMARY OF THE INVENTION

The present invention has been accomplished in view of the state of the arts as described above, and its object is to provide a platen roller which does not generate inferior printing even at a particularly high environment temperature or when the temperature is raised by prolonged use.

According to the present invention, there is provided a platen roller, comprising a rubber material having a glass transition temperature within the range of from −10° C. to 40° C. mounted around a core metal material.

Figure 1:
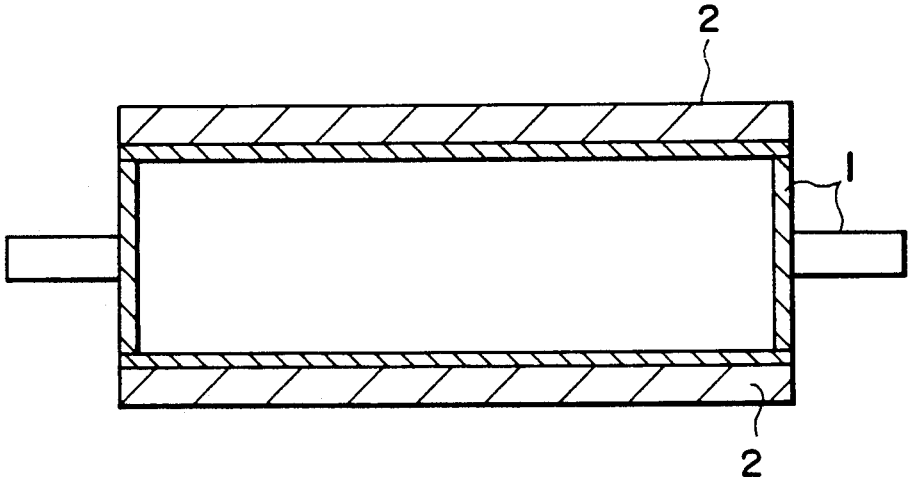
FIG. 1 is a schematic illustration of the platen roller of the present invention.
Figure 2:
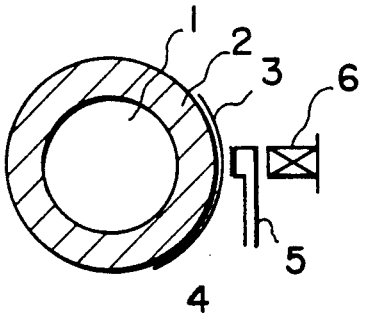
FIG. 2 is a schematic illustration of the portion where printing of the printer is performed.

According to the present invention, in order to prevent generation of inferior printing by increasing the shock attenuating ability in the temperature region ordinarily used, there is employed a rubber material with a glass transition point within the range of from −10° C. to 40° C. which is the temperature region ordinarily used.

The above temperature region of the glass transition point from −10° C. to 40° C. may be preferably from −5° C. to 35° C., and more preferably from 0° C. to 30° C.

The glass transition point as mentioned in the present invention refers to the temperature corresponding to the boundary between the crystal phase and the rubber elastic phase, and it can be measured by measuring the temperature dispersion of tanδ under the conditions of constant strain and constant frequency by use of a dynamic viscoelasticity measuring device.

The range of from −10° C. to 40° C. is higher as compared with the glass transition point of the rubber material for the platen roller of the prior art, and the rubber material having such a high glass transition point can be obtained by formulation of rubber with high crystallinity and/or a thermoelastic elastomer as is known in the art, and is also found to be obtained by formulating specific parts of a vulcanizing agent.

When specific parts, as disclosed in Table 1, of a sulfur vulcanizing agent are formulated, the hardness of the rubber material becomes higher to made shock load greater, whereby further effect can be obtained for prevention of inferior printing.

The rubber material of the platen roller of the present invention can be obtained similarly as the formulation design of the rubber material of the platen rollers in general, by formulating appropriate amounts of the starting polymer (synthetic natural rubber and/or thermoplastic elastomer), carbon, inorganic filler, oil, sulfur, vulcanization aid, vulcanization accelerator, stearic acid, and if desired other peroxides, as the crosslinking agent, plasticizer, reinforcing agent, etc.

As the starting material polymer, rubbers such as SBR, NBR, IR, NR, CR, IIR, BR, etc., or thermoplastic elastomers such as RB, SBS, polyolefin, polyester, polyurethane, PVC, etc., or blends of them can be used.

As the carbon ISAF (Intermediate Super Abrasion Furnace), SAF (Super Abration Furnace), HAF (High Abrasion Furnace Black), FEF (Fast Extruction Furnace), SRF (Semi-Reinforcing Furnace), FT (Fine Thermal), EPC (Easy Processing Channel), MPC (Medium Processing Channel) or a blend thereof can be used.

As the inorganic filler, calcium carbonate, various clays, talc, etc., or blends thereof, and also silica type fillers such as hydrous silicic acid, anhydrous silicic acid and respective salts thereof, etc., may be effectively used.

As the softening agent, aromatic, naphthenic, parafinic vegetable oils, and also mineral oils such as parafinic wax, mineral rubber, etc., can be used. Factice is also available.

As the vulcanization accelerating aid, metal oxides such as zinc oxides, magnesia, etc., or fatty acids, typically stearic acid may be used. As the vulcanization accelerator, aldehyde amines, guanidines, thiazoles, thiurams, dithiocarbamates, xanthogenic acid salts, etc., and various combinations of these may be used.

As the crosslinking agents, peroxides such as dicumyl peroxide, ditertiary butyl peroxide, benzoyl peroxide, etc., otherwise sulfur chloride or organic sulfur containing compounds, metal oxides, quinone dioxime, organic polyvalent amines, modified phenol resins, etc., may be employed.

As the plasticizer, phthalate type such as DBP, DOP, etc., adipate type such as DOA, etc., sebacate type such as DOS, phosphate type such as TCP, etc., or otherwise polyether type, polyester type, etc., may be employed.

Also, as the organic reinforcing agent, high styrene resin, phenol resin, modified melamine resin, etc., may be effectively used.

Also, as the tackifying agent, coumarone-indene resin, phenol-terpene resin, rosin derivative, etc., may be appropriately used.

Also as the aging preventive agent, aldehyde, ketone, amines, and derivatives thereof, or wax type and various combinations of these may be employed.

Also as the peptizing agent, xylylmercaptan, 2-benzamidethiophenol, zinc salt, etc., may be used.

EXAMPLE 1

A rubber with a formulation as shown in Table 1 was placed in a mold and vulcanized at 150° C. for 90 minutes to obtain a cylindrical rubber material with a hardness of 95±3 (JIS-A scale, measured at 20° C.), and by mounting the rubber material onto a core metal material made of aluminum, a platen roller of the present invention was obtained. This platen roller was set on an electronic typewriter (produced by Canon, AP360), and continuous printing of 1000 letters was performed on bank bond paper under the environments of 0° C., 20° C. and 50° C., whereby no inferior printing occurred.

Also, the glass transition temperature of the rubber material of this platen roller was measured according to the method as described above to be 20° C.

Also, a rubber with a formulation as shown in Table 1 was placed in a mold (JIS-K6301; for preparation of a test piece for resilient elasticity test) and press vulcanized at 150° C. for 90 minutes, and the resilient elasticity of the test piece was measured at various temperatures. The results are shown in Table 2.

COMPARATIVE EXAMPLE 1

A platen roller was prepared in the same manner as in Example 1 except for using a rubber with a formulation as shown in Table 3, and the same printing test was conducted. As the results, inferior printing was recognized in printed letters at an environment temperature of about 45° C. or higher.

Also, the glass transition temperature of the rubber material of this platen roller was measured in the same manner as in Example 1 to be −15° C.

REFERENCE EXAMPLE

By use of a large number of platen rollers by use of rubber materials with various formulations having glass transition points of −30° C. to 70° C., the platen rollers were set on the same printer as in Example 1 and continuous printing of 1000 letters was conducted while maintaining the temperature of the rubber material portion at intervals of 5° C. from −30° C. to 100° C. and the number of inferiorly printed letters was measured.

Figure 3:
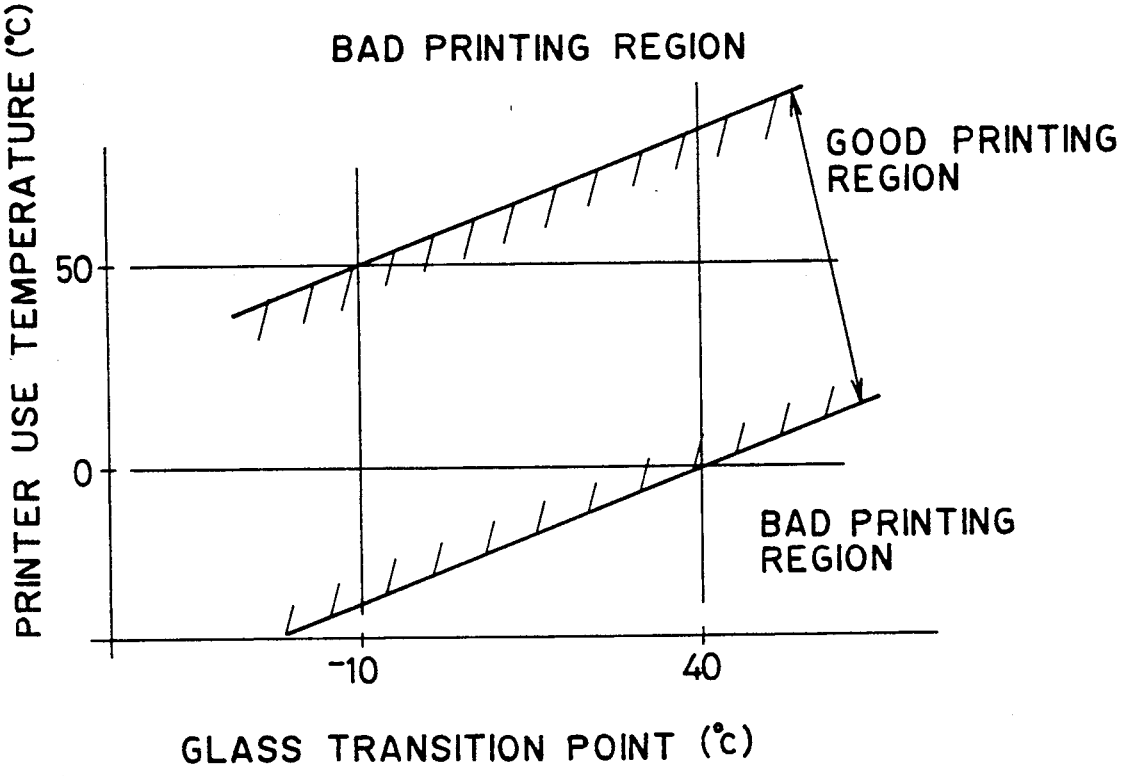
FIG. 3 is a graph showing the state in which the relationship between the glass transition point and its use temperature of the rubber material of the platen roller contributes to superior or inferior of printing.

Judgment of the measured results was made as inferior for those with inferior printing of ten letters or more (lacking letters, lacking a part of the the ink, printed letter or outline is unclear, presence of irregularity in printed density), and as superior for those with less than 10 inferiorly printed letters. And, the glass transition temperatures of the respective rubber materials and the platen roller temperatures were plotted, whereby the existing regions of the points of inferior printing and the points of superior printing were clearly separated from each other. The border line was drawn to give a graph as shown in FIG. 3.

As can be seen from the graph, the platen roller by use of a rubber material within the range from −10° C. to 40° C. can be said to generate no inferior printing even when used at a temperature of 0° C. to 50° C.

TABLE 1

| | Formulation | phr |
|---|---|---|
| (1) | SBR 1502 | 100 |
| (2) | ISAF carbon | 20 |
| (3) | Light fine calcium carbonate | 150 |
| (4) | Working oil (aroma oil) | 10 |
| | Zinc oxide | 3 |
| | Stearic acid | 2 |
| (5) | Vulcanization accelerator D | 1 |
| (6) | Vulcanization accelerator TS | 0.2 |
| | Sulfur | 37 |
| | Total | 323.2 |

Vulcanization conditions 150° C. × 90 min.
Glass transition point about 25° C.
MANUFACTURERS
(1) Japan Synthetic Rubber
(2) Asahi Carbon
(3) Shiraishi Kogyo: Silver W
(4) Nippon Sun oil
(5), (6) Ouchi Shiko Kagaku
(7) Asahi Carbon

TABLE 2

| Temperature (°C.) | 10 | 20 | 30 | 40 |
|---|---|---|---|---|
| Resilient elasticisty (%) | 12 | 6 | 9 | 15 |

TABLE 3

| | Formulation | phr |
|---|---|---|
| | SBR 1502 | 100 |
| | ISAF carbon | 40 |
| (7) | HAF carbon | 40 |
| | Light fine calcium carbonate | 100 |
| | Aroma oil | 15 |
| | Zinc oxide | 3 |
| | Stearic acid | 2 |
| | Vulcanization accelerator D | 1.5 |
| | Vulcanization accelerator TS | 0.5 |
| | Sulfur | 2.0 |
| | Total | 304 |

Vulcanization conditions 150° C. × 90 min.
Glass transition point about −15° C.

As described above, the platen roller of the present invention can give printed letters of superior quality for a long time even at the high environmental temperature, and this can be obtained by a simple operation of setting of a glass transition temperature, whereby economical improvement can be accomplished.

What is claimed is:

1. An impact typewriter comprising a platen roller, comprising:

a cylindrical rubber member having a glass transition temperature within the range of −10° C., with said cylindrical member being formed from a rubber material synthesized by using a polymer, carbon, an inorganic filler, an oil, sulfur, a vulcanization aid, a vulcanization accelerator and stearic acid as starting materials; and support means for supporting said cylindrical rubber member, wherein said rubber member is mounted around said support means.

2. An impact typewriter according to claim 1, wherein the glass transition temperature is −5° C. to 35° C.

3. An impact typewriter according to claim 2, wherein the glass transition temperature is 0° C. to 30° C.

4. An impact typewriter according to claim 1, wherein said polymer is a rubber selected from a blend on one or more of SBR, IR, NR, CR, IIR and BR.

5. An impact typewriter according to claim 1, wherein said polymer is a thermoplastic elastomer selected from a blend of one or more of RB, SBS, polyolefin, polyester, polyurethane and PVC.

* * * * *

UNITED STATES PATENT AND TRADEMARK OFFICE

CERTIFICATE OF CORRECTION

PATENT NO. : 5,008,138

DATED : April 16, 1991

INVENTOR(S) : Jun Murata

It is certified that error appears in the above-identified patent and that said Letters Patent is hereby corrected as shown below:

COLUMN 5:

Line 2, "-10°C.," should read -- -10°C to 40°C,--.

COLUMN 6:

Line 9, "on" should read --of--, and "SBR" should read --SBR, NBR--.

Signed and Sealed this

Twenty-fourth Day of November, 1992

*Attest:*

DOUGLAS B. COMER

*Attesting Officer*

*Acting Commissioner of Patents and Trademarks*